US005987689A

United States Patent [19]

Gordon

[11] Patent Number: 5,987,689

[45] Date of Patent: Nov. 23, 1999

[54] GUM AND DENTURE CLEANING SYSTEM

[76] Inventor: Ray Gordon, 1218 S. Washington, Grand Forks, N. Dak. 58201

[21] Appl. No.: 08/959,894

[22] Filed: Oct. 29, 1997

[51] Int. Cl.[6] ..... A46B 9/04

[52] U.S. Cl. ..... 15/167.1; 15/144.2

[58] Field of Search ..... 15/144.2, 167.1; 134/6; 433/216

[56] References Cited

U.S. PATENT DOCUMENTS

| | | | |
|---|---|---|---|
| 1,779,057 | 10/1930 | Tolmach | 15/144.2 |
| 2,022,039 | 11/1935 | House | 15/144.2 |
| 2,427,411 | 9/1947 | Krueger | 15/144.2 |
| 4,570,282 | 2/1986 | Kaufman et al. | 15/167.1 |
| 4,654,922 | 4/1987 | Chen | 15/144.2 |
| 4,796,325 | 1/1989 | Bortman | 15/144.2 |
| 5,032,082 | 7/1991 | Herrera | 15/167.1 |
| 5,660,546 | 8/1997 | Shafer | 433/216 |

*Primary Examiner*—Terrence R. Till

*Attorney, Agent, or Firm*—Michael S. Neustel

[57] ABSTRACT

A gum and denture cleaning system for cleaning adhesive from the gums and dentures of a denture wearer thereby increasing the wearer's comfort and increasing the effectiveness of new adhesive applied to the dentures. The gum cleaning system cleans and stimulates the gums of the user leaving the gums feeling cleaner and refreshing. The inventive device includes a base, a handle pivotally connected to a side of the base, and a plurality of cleaning bristles projecting from the base opposite of the handle. The bristles contain a depression having a substantially V-shaped cross section concentrically positioned. The gums or dentures of the user are cleaned by the bristles engaging and removing the denture adhesive from them. In a second embodiment, a denture cleaner comprises a gripping member, an elongated member, a ring support a plurality of outer bristles and inner bristles which define a circular channel. The dentures are positioned within the channel between the outer bristles and the inner bristles whereby the denture adhesive is removed from the user agitating the dentures within the channel.

7 Claims, 2 Drawing Sheets

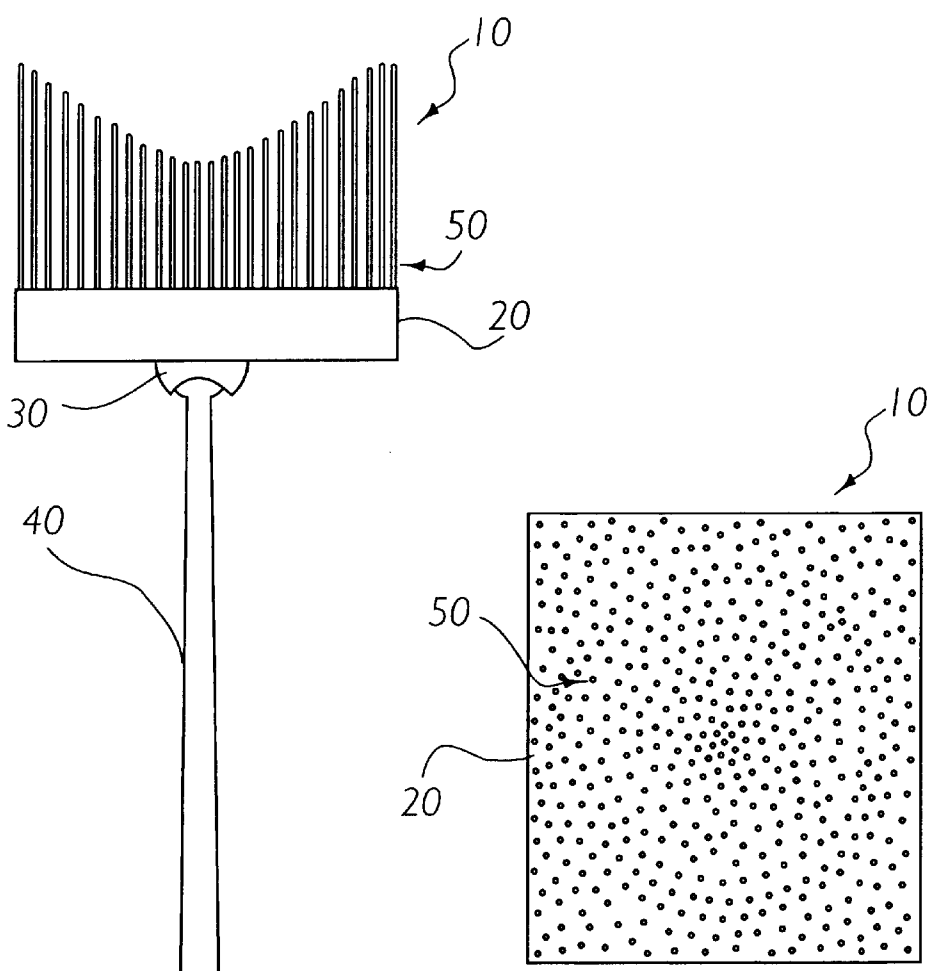
FIG. 2
FIG. 3
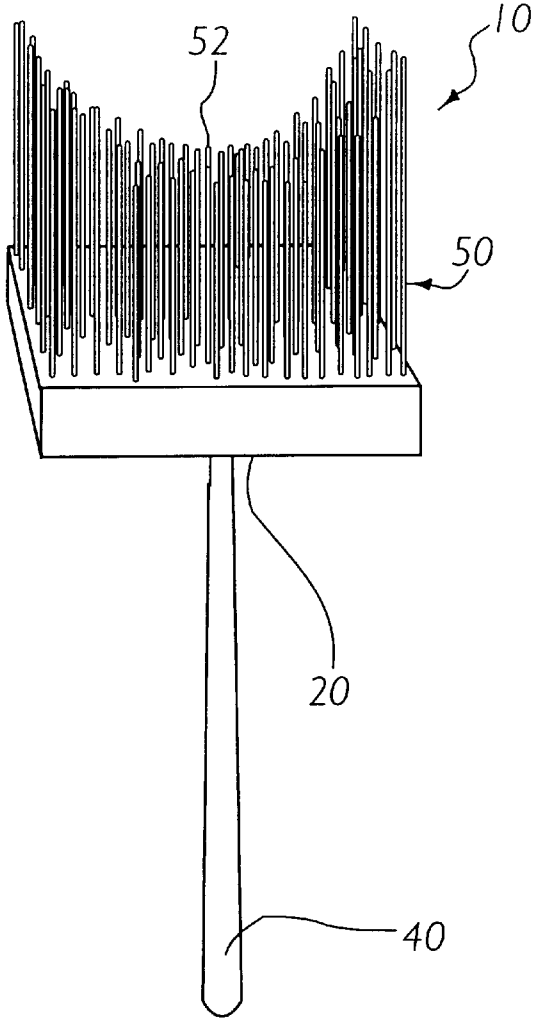
FIG. 1

GUM AND DENTURE CLEANING SYSTEM

BACKGROUND OF THE INVENTION

1. Field of the Invention

The present invention relates generally to brush devices and more specifically it relates to a gum and denture clearing system for cleaning adhesive and other debris from the gums and dentures of a denture wearer thereby increasing the wearer's comfort and increasing the effectiveness of new adhesive applied to the dentures. The gum cleaning system stimulates the gums during and after cleaning leaving the gums of the user feeling clean and refreshing.

2. Description of the Prior Art

There are numerous brush devices. For example, U.S. Pat. No. 4,796,325 to Bortman; U.S. Pat. No. 4,757,570 to Haeusser et al; U.S. Pat. No. 4,610,045 to Rauch; U.S. Pat. No. 5,491,866 to Simonds; U.S. Pat. No. 3,994,039 to Hadary; U.S. Pat. No. 4,783,874 to Perches et al; U.S. Pat. No. 4,033,007 to Hadary; U.S. Pat. No. 4,488,328 to Hyman; U.S. Pat. No. 4,370,773 to Hadary; U.S. Pat. No. 5,572,763 to Eguchi; U.S. Pat. No. 369,243 to Hunt; U.S. Pat. No. 5,324,129 to Root; U.S. Pat. No. 5,247,718 to Victorian; U.S. Pat. No. 5,528,786 to Porat et al are illustrative of such prior art.

Bortman (U.S. Pat. No. 4,796,325) discloses an angularly adjustable double headed toothbrush which a brush portion pivotally connected to the handle. The head portion of Bortman may be provided with a pair of opposing brushes for simultaneously brushing both sides of a tooth. Bortman does not disclose a brush for brushing three sides of the gums of a denture wearer.

Haeusser et al (U.S. Pat. No. 4,757,570) discloses a toothbrush for simultaneous cleaning of teeth on both sides. Haeusser discloses a handle, a bristle holder having a U-shaped cross section, and a plurality of bristles in the bristle holder facing inward. Haeusser does not disclose a pivoting means for allowing the bristle holder to remain parallel to the teeth during cleaning.

Rauch (U.S. Pat. No. 4,610,045) discloses a toothbrush with a teeth brushing surface and two gum treatment brush surfaces for massaging the gums during casual brushing. Rauch does not disclose a pivoting means for allowing the bristle holder to remain parallel to the teeth during cleaning.

While these devices may be suitable for the particular purpose to which they address, they are not as suitable for cleaning adhesive from the gums and dentures of a denture wearer thereby increasing the wearer's comfort and increasing the effectiveness of new adhesive applied to the dentures. None of the prior art discloses a brush capable of effectively cleaning the dentures from a denture adhesive. Further, none of the prior art discloses a brush capable of massaging and cleaning all three sides of the gums while maintaining a parallel position of all of the bristles with respect to the gums of the user.

In these respects, the gum and denture cleaning system according to the present invention substantially departs from the conventional concepts and designs of the prior art, and in so doing provides an apparatus primarily developed for the purpose of cleaning adhesive from the gums and dentures of a denture wearer thereby increasing the wearer's comfort and increasing the effectiveness of new adhesive applied to the dentures.

SUMMARY OF THE INVENTION

A primary object of the present invention is to provide a gum and denture cleaning system that will overcome the shortcomings of the prior art devices.

Another object is to provide a gum and denture cleaning system that removes denture adhesive from the gums and dentures of a user.

An additional object is to provide a gum and denture cleaning system that maintains the bristles parallel to the gums of the user during cleaning so as to effectively stimulate and clean the gums of the user leaving the gums feeling clean and refreshing.

A further object is to provide a gum and denture cleaning system that cleans denture adhesive from the gums and dentures of the user.

Another object is to provide a gum and denture cleaning system that provides a clean surface for a new application of dental adhesive to be applied thereby increasing the strength of the bonding of the dentures to the gums.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 1 is an upper perspective view of the present invention.

FIG. 2 is a side view of the present invention.

FIG. 3 is a top view of the present invention.

DESCRIPTION OF THE PREFERRED EMBODIMENT

Figure 4:
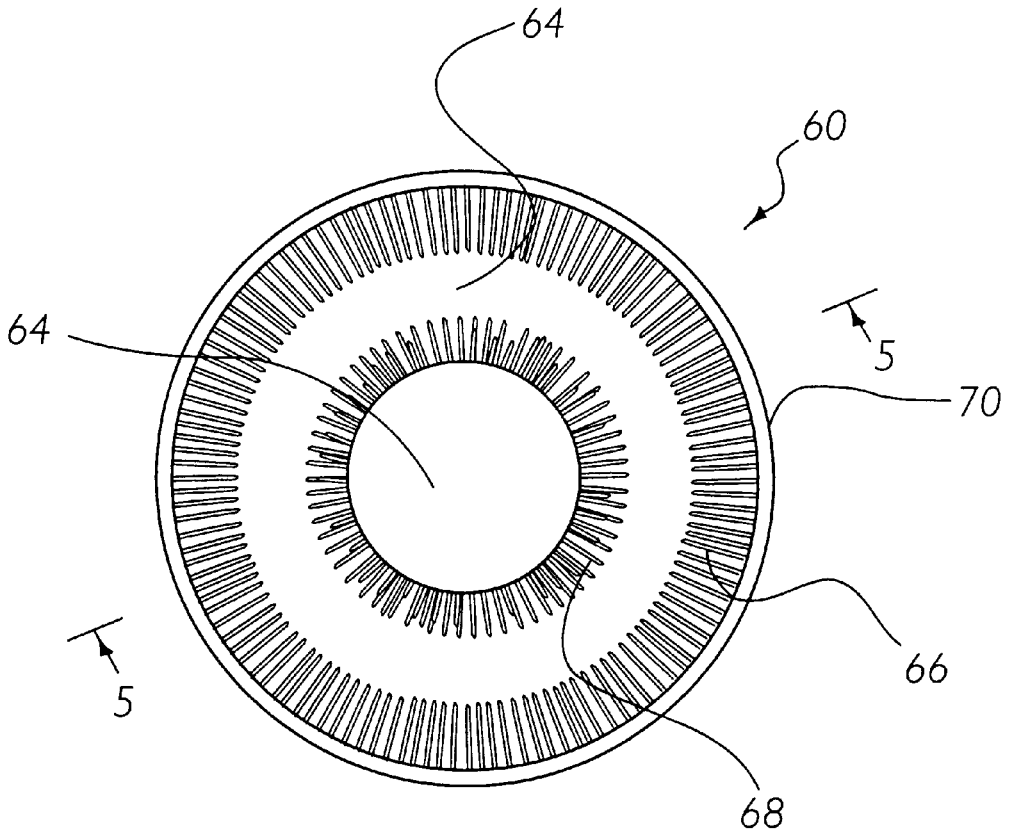
FIG. 4 is a top view of a second embodiment.
Figure 5:
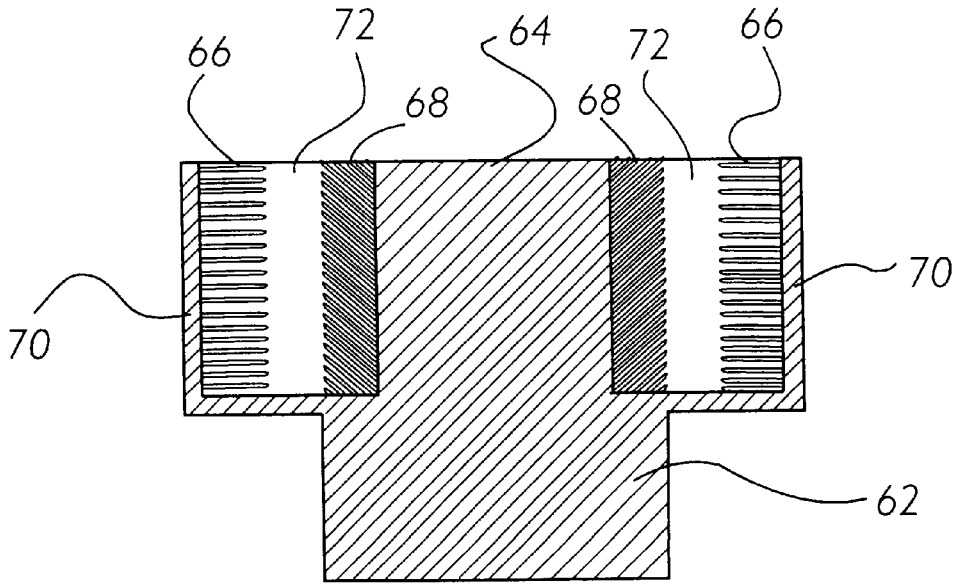
FIG. 5 is a cross sectional view taken along line 5—5 of FIG. 4 illustrating the outer bristles and the inner bristles.

Turning now descriptively to the drawings, in which similar reference characters denote similar elements throughout the several view, FIGS. 1 through 5 illustrate a gum and denture cleaning system 10, which comprises a base 20, a handle 40 pivotally connected to a side of the base 20, and a plurality of cleaning bristles 50 projecting from the base 20 opposite of the handle 40. The bristles contain a depression 52 having a substantially V-shaped cross section concentrically positioned. The gums or dentures of the user are cleaned by the bristles 50 engaging and removing the denture adhesive from them. In a second embodiment as shown in FIGS. 4 and 5, a denture cleaner 60 comprises a gripping member 62, an elongated member 64, a ring 70 support a plurality of outer bristles 66 and inner bristles 68 which define a circular channel 72. The dentures are positioned within the channel 72 between the outer bristles 66 and the inner bristles 68 whereby the denture adhesive is removed from the user agitating the dentures within the channel 72. Other material such as foam, sponge or other semi-abrasive material may be utilized in substitute for the bristles 50, 66, 68.

As shown in FIGS. 1 through 3, the handle 40 is elongated to allow the user to reach the rear portions of the gums. An end of the handle 40 is connected to a ball and socket joint 30 as best shown in FIG. 2 of the drawings. The ball and socket joint 30 allows the base 20 to radially pivot about the handle 40 to maintain the bristles flush with respect to the gums regardless of the position in the mouth. The ball and socket joint 30 is attached to the side of the base 20 opposite of the bristles 50 as best shown in FIG. 2 of the drawings. As best shown in FIGS. 1 and 3 of the drawings, the base 20 is preferably square or rectangular shaped. In the rectangular shaped embodiment, the longitudinal axis of the depression 52 is substantially parallel to a longitudinal axis of the base 20 to allow great stability during brushing.

As best shown in FIG. 1 of the drawings, the bristles 50 preferably project substantially orthogonal to the base 20 away from the handle 40. The bristles 50 can be angled inwardly to achieve a more direct contact with the gums of the user. The depression 52 is formed to the contours of the user's gums or dentures so as to adequately clean all three sides of the gums and dentures of the user. The depression 52 has a substantially V-shaped cross section as best shown in FIG. 2 of the drawings. The depression 52 within the bristles 50 receives the gums and allows the bristles 50 to clean the denture adhesive therefrom. The depression 52 within the bristles 50 is capable of receiving the gum portions of dentures also for cleaning the denture adhesive from them.

In a second embodiment, as shown in FIGS. 4 and 5 of the drawings, a denture cleaner 60 is provided for cleaning the gum portions of dentures of the user. The denture cleaner 60 comprises a gripping member 62 ergonomically formed to allow the user to grip with one hand. An elongated member 64 is attached to an end of the gripping member 62 substantially coaxially as shown in FIG. 5. A ring 70 is attached coaxially about an outer portion of the gripping member 62 and a constant distance away from the elongated member 64. The ring 70 forms a channel 72 about the elongated member 64 where the dentures are received.

As best shown in FIG. 5 of the drawings, a plurality of outer bristles 66 are attached to an inner surface of the ring 70 projecting radially inward toward a common axis of the elongated member 64. The outer bristles 66 may be angled upwardly or downwardly. Preferably the outer bristles 66 are substantially orthogonal to the common axis as shown in FIG. 5 of the drawings to clean the outer gum surfaces of the dentures. As further shown in FIG. 5 of the drawings, a plurality of inner bristles 68 are radially attached to the elongated member 64 projecting toward the outer bristles 66. The inner bristles 68 may be orthogonal to the common axis, angled upwardly or angled downwardly. Preferably, the inner bristles 68 are angled upwardly, as shown in FIG. 5, to clean the inner gum surface of the dentures. A plurality of unnumbered central bristles may also be attached to the gripping member 62 centrally positioned within the channel 72 and projecting substantially parallel to the common axis. The plurality of unnumbered central bristles clean the edge gum surface of the dentures opposite of the false teeth.

In use, the user removes their dentures from their mouth. The handle 40 is manipulated so as to position the base 20 with the bristles 50 within the user's mouth. The bristles 50 are then positioned juxtaposed to the gums of the user so as to clean the lower and side surfaces of the gums from the denture adhesive and other debris leaving the user's gums refreshingly clean. The user then agitates the handle 40 so as to rub the bristles 50 against the surfaces of the gums removing the denture adhesive and stimulating the gums. The cleaned gums are left feeling stimulated and refreshed feeling to the user.

In use of the second embodiment, the dentures are removed from the user's mouth and placed within the channel 72 between the ring 70 and the elongated member 64. The user agitates the dentures along the channel 72 forcing the inner bristles 68 to engage and clean the inner gum surfaces of the dentures. The agitation also forces the outer bristles 66 to engage and clean the outer gum surfaces of the dentures.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A gum and denture cleaning brush, comprising:

a base having a first side, a second side and an outer perimeter, wherein said first side is opposite of said second side;

a cleaning means attached to said first side, wherein said cleaning means has a V-shaped cross-sectional area;

a pivoting means attached on said second side of said base directly opposite of said cleaning means;

a handle attached to said pivoting means, whereby said pivoting means allows said base and said cleaning means to pivot about said handle thereby maintaining said cleaning means substantially flush with said gums or said dentures during cleaning; and wherein said depression has a substantially V-shaped cross section having a longitudinal axis.

2. The gum and denture cleaning system of claim 1, wherein said pivoting means comprises a ball and socket joint.

3. The gum and denture cleaning system of claim 2, wherein said cleaning means comprises a plurality of bristles substantially orthogonal to said base.

4. The gum and denture cleaning system of claim 3, wherein said bristles are formed from a resilient material.

5. The gum and denture cleaning system of claim 1, wherein said base is rectangular shaped having a longitudinal axis substantially parallel to said longitudinal axis of said depression for providing increased stability of said base and said cleaning means with respect to said gums during agitation.

6. A method of cleaning gums and dentures of a denture adhesive and other debris, said method comprising the steps of:

removing said dentures from said gums;

applying a brush, according to claim 3, to surfaces of said dentures and said gums which contain said denture adhesive;

rubbing said brush against said surfaces thereby removing said denture adhesive; and repeating said rubbing said brush until said surfaces are removed of said denture adhesive and other debris.

7. The method of cleaning gums and dentures of claim 6, wherein said brush includes a V-shaped depression for receiving said gums and said dentures.

* * * * *